US005229028A

United States Patent [19]

Boutique et al.

[11] Patent Number: 5,229,028

[45] Date of Patent: Jul. 20, 1993

[54] LIQUID DETERGENT COMPOSITIONS

[75] Inventors: Jean-Pol Boutique, Gembloux; Karel J. M. Depoot, Waregem, both of Belgium

[73] Assignee: The Procter & Gamble Company, Cincinnati, Ohio

[21] Appl. No.: 758,657

[22] Filed: Sep. 12, 1991

[30] Foreign Application Priority Data

Sep. 17, 1990 [EP] European Pat. Off. ..... 90870148.5

[51] Int. Cl.[5] ..... C11D 3/20; C11D 7/26; C11D 9/26

[52] U.S. Cl. ..... 252/142; 252/173; 252/174.19; 252/DIG. 14

[58] Field of Search ..... 252/142, 173, 174.19, 252/174.21, DIG. 14

[56] References Cited

U.S. PATENT DOCUMENTS 3,579,453 5/1971 Dupre et al. ..... 252/174.19
4,844,821 7/1989 Mermelstein et al. ..... 252/174.25

FOREIGN PATENT DOCUMENTS 0212723 4/1987 European Pat. Off. .
0293040 11/1988 European Pat. Off. .
0294904 12/1988 European Pat. Off. .
2197340 5/1988 United Kingdom .

*Primary Examiner*—Asok Pal
*Assistant Examiner*—P. Achutamurthy
*Attorney, Agent, or Firm*—Fernando A. Borrego; Donald E. Hasse; Ronald L. Hemingway

[57] ABSTRACT

Stable aqueous liquid detergent compositions are disclosed which comprise surfactants and a builder system comprising a major amount of citrate and a minor amount of $C_{10}$–$C_{16}$ alkyl or alkenyl substituted succinic acid.

8 Claims, No Drawings

LIQUID DETERGENT COMPOSITIONS

TECHNICAL FIELD

The present invention relates to aqueous liquid detergent compositions, and provides a builder system comprising a predominant amount of citric acid. The detergent compositions according to the invention are physically stable, and have good building capacity.

BACKGROUND

Builder systems are key elements in detergent compositions. Indeed, they allow to counteract the deleterious effects of multivalent ions of the water, soils or fibers on the washing process. The prior art on builder systems is very crowded since detergent manufacturers have constantly been trying to improve the performance of the builder systems in their products, and have proposed sophisticated builder systems. This effort has been even more important in the field of liquid heavy duty detergents, so as to match the performance of granular detergent compositions.

Because of environmental issues, detergent manufacturers are constantly trying to formulate detergent compositions which contain environmentally compatible ingredients and have outstanding performance. It is well known that citric acid may act as a builder in detergents, and citric acid enjoys a well-established safety pedigree. It is therefore desirable to formulate an aqueous liquid detergent composition comprising citric acid as a builder.

It is also well known that citric acid has a rather poor building performance compared to other builders; in other terms, in order to obtain an acceptable building performance in a given detergent composition containing citric acid as a builder, one will have to incorporate important amounts of citric acid. However, high levels of citric acid in an aqueous liquid detergent will inevitably lead to physical stability problems, in that such a detergent will split in two phases, one of which contains essentially water and the most of the citric acid, the other comprising water and the most of the surfactant. This problem is even more acute in detergent compositions containing high amounts of surfactants.

Without specifically addressing this stability problem, compositions containing citric acid and which are said to be stable are disclosed for instance in EP 0 237 075, US 4 532 067, DE 2 203 004. The problem is more specifically addressed in DE 3 544 236, GB 2 140 819 or GB 2 140 818. The above references all recommend the introduction in the compositions of solvents or hydrotropes.

US 4,780,234 provides an alternative in that it discloses liquid detergent compositions comprising builders including citric acid, wherein the phase stability problem is solved by using a specific alkyl glycoside surfactant.

It has now been found that an alternative to the above solutions could be found in that a stable aqueous liquid detergent composition containing a major amount of citric acid can be formulated by incorporating therein a minor amount of an alk(en)yl substituted succinic acid, which is an auxiliary builder compound; this specific compound has already been described as a builder in the art; indeed, EP 0 212 723 and GB 2 197 340 disclose liquid detergent compositions comprising both citric acid and an alk(en)yl substituted succinic acid. However, these compositions are opposite to the compositions of the present invention in that they contain only a minor amount of citric acid, and the major constituent of the builder system is the substituted succinic acid.

SUMMARY OF THE INVENTION

The compositions according to the present invention are stable aqueous liquid detergent compositions comprising From 5% to 40 % by weight of the total composition of a surfactant system, and a builder system comprising from 6% to 20% by weight of the total composition of citric acid from 1% to 10% by weight of the total composition of a $C_{10-16}$ alkyl or alkenyl substituted succinic acid, wherein the weight ratio of citric acid to the substituted succinic acid is of from 1.2:1 to 10:1.

DETAILED DESCRIPTION OF THE INVENTION

The essential component of the compositions of the invention is a specific builder system, which comprises a major amount of citric acid, and a minor amount of a substituted succinic acid.

In this description, the expressions "citric acid", "citric acid monohydrate" and "citrate" are used interchangeably, as well as "succinic" acid and "succinate"; however, all percentages are expressed on the basis of citric acid monohydrate and alk(en)yl succinic acid in the diacid form.

The citric acid builder employed in the practice of this invention will be present in the finished product in the form of any water-soluble salt of citric acid. Such salts include, for example, sodium, potassium, ammonium or alkanolammonium salts. In practice, however, it is preferred to use a citric acid monohydrate slurry as a starting material, which will be neutralized in situ, so as to form the above mentioned salts. Accordingly, the compositions of the invention contain from 6% to 20% by weight of the total composition of citric acid monohydrate, preferably from 8% to 14%.

The substituted succinic acid builders herein are of the general formula R—CH(COOH)$CH_2$(COOH), i.e., derivatives of succinic acid, wherein R is $C_{10}$–$C_{16}$ alkyl or alkenyl, preferably $C_{12}$–$C_{14}$ alkenyl.

These substituted succinic acid builders are preferably in the finished product in the form of their water-soluble salts, including the sodium, potassium, ammonium and alkanolammonium salts (e.g., mono-, di-, or tri-ethanolammonium).

As raw materials, it is preferred to use these succinic acid derivatives in their diacid or anhydride form. The diacid will be neutralized in situ, while the anhydride will undergo a hydrolysis/neutralization process.

Specific examples of substituted succinic acid builders include : lauryl succinic acid, myristyl succinic acid, palmityl succinic acid, 2-dodecenyl succinic acid (preferred), 2-tetradecenyl succinic acid, and the like.

The compositions according to the present invention contain from 1% to 10% by weight of the total composition of the above substituted succinic acids, preferably from 2% to 6%.

So as to ensure the physical stability of the compositions according to the invention, it has been found that it is essential to observe a weight ratio of citric acid monohydrate to the substituted succinic acid builders in the range of from 1.2:1 to 10:1. Preferably, this ratio will be in the range of from 1.5:1 to 6:1, most preferably, this ratio will be in the range of from 1.8:1 to 2.5:1.

The liquid detergent compositions herein also contain from 5% to 40% by weight of the total liquid detergent composition, preferably from by weight 10% to 30% by weight of an organic surface-active agent selected from nonionic, anionic, and zwitterionic surface-active agents and mixtures thereof.

Suitable anionic surface-active salts are selected from the group of sulfonates and sulfates. The like anionic surfactants are well-known in the detergent arts and have found wide application in commercial detergents. Preferred anionic water-soluble sulfonate or sulfate salts have in their molecular structure an alkyl radical containing from about 8 to about 22 carbon atoms.

Examples of such preferred anionic surfactant salts are the reaction products obtained by sulfating $C_8$–$C_{18}$ fatty alcohols derived from e.g. tallow oil, palm oil, palm kernel oil and coconut oil; alkylbenzene sulfonates wherein the alkyl group contains from about 9 to about 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium, potassium or alkanolammonium.

A suitable anionic synthetic surfactant component herein is represented by the water-soluble salts of an alkylbenzene sulfonic acid, preferably sodium alkylbenzene sulfonic acid, preferably sodium alkylbenzene sulfonates having from about 10 to 13 carbon atoms in the alkyl group.

A particularly preferred anionic surfactant component herein is sodium alkyl sulfates having from about 10 to 15 carbon atoms in the alkyl group.

The nonionic surfactants suitable for use herein include those produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_{20})_nH$ wherein R represents the hydrophobic moiety, A represents the group carrying the reactive hydrogen atom and n represents the average number of ethylene oxide moieties R typically contains from about 8 to 22 carbon atoms They can also be formed by the condensation of propylene oxide with a lower molecular weight compound. n usually varies from about 2 to about 24.

A preferred class of nonionic ethoxylates is represented by the condensation product of a fatty alcohol having from 12 to 15 carbon atoms and from about 4 to 10 moles of ethylene oxide per mole or fatty alcohol. Suitable species of this class of ethoxylates include : the condensation product of $C_{12}$–$C_{15}$ oxo-alcohols and 3 to 9 moles of ethylene oxide per mole of alcohol; the condensation product or narrow cut $C_{14}$–$C_{15}$ oxo-alcohols and 3 to 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol: and the condensation products of a $C_{10}$–$C_{14}$ coconut fatty alcohol with a degree of ethoxylation (moles EO/mole fatty alcohol) in the range from 4 to 8. The fatty oxo alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation.

A preferred surfactant system according to the present invention is a mixture of $C_{12}$–$C_{15}$ alkyl sulfate with ethoxylated nonionic surfactant.

Zwitterionic surfactants include derivatives of aliphatic quaternary ammonium, phosphonium, and sulfonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. No. 3,925,262, Laughlin et al., issued Dec. 9, 1975 and U.S. Pat. No. 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Detergent enzymes can be used in the liquid detergent compositions of this invention. In fact, one of the desirable features of the present compositions is that they are compatible with such detergent enzymes. Suitable enzymes include the detergent proteases, amylases, lipases and cellulases.

Compositions according to the invention may also contain a water soluble, peroxygen bleach. Examples of suitable water-soluble solid peroxygen compounds include the perborates, persulfates, peroxydisulfates, perphosphates and the crystalline peroxyhydrates formed by reacting hydrogen peroxide with sodium carbonate or urea. Preferred peroxygen bleach compounds are sodium perborate monohydrate and sodium perborate tetrahydrate.

According to the invention, many liquid detergent compositions contain, in addition to water, a water-miscible organic solvent. Examples of suitable water-miscible organic solvents include the lower aliphatic monoalcohols, and ethers of diethylene glycol and lower monoaliphatic monoalcohols. Preferred solvents are ethanol, iso-propanol, 1-methoxy 2-propanol and butyldiglycolether, 1,2 propanediol.

The compositions according to the invention may also contain a fatty acid. The amount of fatty acid is preferably less than 5% by weight. Preferred are oleic and palmitoleic acid.

The compositions herein can contain a series of further optional ingredients which are mostly used in additive levels, usually below about 5%. Examples of the like additives include : suds regulants, opacifiers, agents to improve the machine compatibility in relation to enamel-coated surfaces, bactericides, dyes, perfumes, brighteners and the like.

The liquid compositions herein can contain further additives of a level from 0.05 to 2%.

These additives include polyaminocarboxylates such as ethylenediaminotetracetic acid, diethylenetriaminopentacetic acid, ethylenediamino disuccinic acid or water-soluble alkali metals thereof. Other additives include organo-phosphonic acids; particularly preferred are ethylenediamino tetramethylenephosphonic acid, hexamethylenediamino tetramethylenephosphonic acid, diethylenetriamino pentamethylenephosphonic acid and aminotrimethylenephosphonic acid.

The compositions may further contain bleach stabilizers of the kinds known in the art. If a process involving the use of hydrogen peroxide is used for the preparation of the liquid detergent, typical bleach stabilizers may be present as introduced with the commercially available hydrogen peroxide. Examples of suitable bleach stabilizers include ascorbic acid, dipicolinic acid, sodium stannates and 8-hydroxyquinoline can also be included in these compositions, at levels between 0.01 and 1%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 1.5%, most preferably between 0.1% and 1.0%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The liquid detergent compositions of this invention further can comprise an agent to improve the washing machine compatibility, particularly in relation to enamel-coated surfaces.

It can further be desirable to add from 0.1% to 5% of known antiredeposition and/or compatibilizing agents. Examples of the like additives include : sodium carboxymethylcellulose; hydroxy-$C_{1-6}$-alkyl-cellulose; polycarboxylic homo- or copolymeric ingredients, such as : polymaleic acid, a copolymer of maleic anhydride and methylvinylether in a molar ratio of 2:1 to 1:2; and a copolymer of an ethylenically unsaturated monocarboxylic acid monomer, having not more than 5, preferably 3 or 4 carbon atoms, for example (methyl)-acrylic acid, and an ethylenically unsaturated dicarboxylic acid monomer having not more than 6, preferably 4 carbon atoms, whereby the molar ratio of the monomers is in the range from 1:4 to 4:1, said copolymer being described in more detail in European patent Application 0 066 915, filed May 17, 1982.

The following examples illustrate the invention and facilitate its understanding.

EXAMPLES

The following compositions are made, comprising the listed ingredients in the listed proportions.

Composition 1 is representative of this prior art in that its builder system contains a major amount of substituted succinic acid, and a minor amount of citric acid.

Composition 2 is a formulation comprising citric acid only as a builder.

Composition 3 and 4 are compositions according to the invention, in that their builder systems comprise a major amount of citric acid and a minor amount of substituted succinic acid.

| INGREDIENTS | FORMULATIONS 1 | 2 | 3 | 4 |
|---|---|---|---|---|
| $C_{12-14}$ alkyl substituted succinic acid | 11.1 | — | 4.9 | 5.6 |
| Citric acid monohydrate | 4.1 | 12 | 9 | 11 |
| Sodium coconut alkyl sulfate | 8.0 | 8.0 | 8.0 | 8.0 |
| Condensation product of 7 moles of ethylene oxide with 1 mole alcohol | 8.4 | 8.4 | 8.4 | 8.4 |
| Diethylenetriamine penta (methylene phosphonic acid) | 0.2 | 0.2 | 0.2 | 0.2 |
| Oleic acid | 1.8 | 1.8 | 1.8 | 1.8 |
| Ethanol | 4 | 4 | 4 | 4 |
| Protease | 0.23 | 0.23 | 0.23 | 0.23 |
| Na metaborate | 2.2 | 2.2 | 2.2 | 2.2 |
| Amylase | 0.08 | 0.08 | 0.08 | 0.08 |
| Suds suppressor | 0.15 | 0.15 | 0.15 | 0.15 |
| NaOH | | up to pH 7.5 | | |
| Water, aesthetics & minors | | up to 100 p | | |

for each of these compositions, the building capacity is calculated and the physical stability checked.

The building capacity is a theoretical calculation of the capacity of a given builder system to bind calcium. It is calculated using the formula $$X = \left[ \frac{\text{\% succinic builder in finished product}}{\text{molecular weight of succinic builder (292)}} + \frac{\text{\% citric acid monohydrate in finished product}}{\text{molecular weight of citric acid monohydrate (210)}} \right]$$

this value is then expressed or 180 g of product in a 18 liters wash liquor, i.e. $X \times 1.8/18 \times 1000$ (mmoles/1).

| The results were: | |
|---|---|
| Composition 1 | 5.75 |
| Composition 2 | 5.71 |
| Composition 3 | 5.96 |
| Composition 4 | 7.16 |

While composition 1 was stable, composition 2 split in two liquid phases directly after making. Compositions 3 and 4 according to the inventors were physically stable and had a better building capacity than compositions 1 and 2.

Other compositions according to the invention were made by mixing the listed ingredients in the listed proportions.

| | 5 | 6 | 7 | 8 | 9 | 10 | 11 | 12 |
|---|---|---|---|---|---|---|---|---|
| $C_{12-14}$ alkenyl succinic acid | 5.3 | 3 | 6.0 | 5.0 | 5.5 | 5.5 | 8.0 | 5.0 |
| Citric acid monohydrate | 9.0 | 10 | 8.0 | 9.0 | 11.0 | 11.0 | 15.0 | 15.0 |

-continued

| | 5 | 6 | 7 | 8 | 9 | 10 | 11 | 12 |
|---|---|---|---|---|---|---|---|---|
| Linear alkyl benzene sulphonate | 9.0 | — | — | 7.0 | — | 6.0 | — | 4.5 |
| Sodium $C_{12-15}$ alkyl sulphate | — | 8.0 | 12.0 | 3.0 | — | — | 8.0 | — |
| Sodium sulfate of $C_{12-15}$ alcohol 2 times ethoxylated | — | — | — | — | — | 3.0 | 3.0 | 4.5 |
| $C_{12-15}$ alcohol 7 times ethoxylated | 8.0 | — | — | 8.0 | 6.0 | 6.0 | 8.0 | — |
| $C_{12-15}$ alcohol 5 times ethoxylated | — | 8.0 | 6.0 | — | — | — | — | — |
| Sodium paraffine sulphonate | — | — | — | — | 10.0 | — | — | — |
| Diethylene triamine penta (methylene phosphonic acid) | 0.7 | 0.2 | 0.5 | — | 0.5 | 0.5 | — | — |
| Oleic acid | — | 1.8 | 1.8 | 1.8 | 3.5 | 3.5 | — | — |
| Ethanol | 4.0 | 4.0 | 4.0 | 4.0 | 4.0 | 4.0 | 4.0 | — |
| Propanediol | 2.0 | 2.0 | — | 2.0 | 2.0 | 2.0 | 2.0 | 4.5 |
| Protease | 0.2 | 0.2 | 0.2 | — | 0.2 | 0.2 | 0.2 | 0.23 |
| Na metaborate | 2.2 | — | 2.2 | 2.2 | 2.2 | 2.2 | — | — |
| Amylase | — | 0.08 | 0.08 | 0.08 | 0.08 | 0.08 | 0.08 | 0.2 |
| Suds suppressor | 0.15 | 0.15 | 0.15 | 0.15 | 0.15 | 0.15 | 0.15 | 0.2 |
| NaOH | | | | up to pH 7.5 | | | | |
| Water and minors | | | | up to 100 parts | | | | |

We claim:

1. A phase-stable, aqueous liquid detergent composition comprising from 5% to 40% by weight of the total composition of a surfactant system, and a builder system, wherein the builder system comprises from 8% to 20% by weight of the total composition of citric acid, and from 1 to 6% by weight of the total composition of $C_{10}$–$C_{16}$ alkyl or alkenyl substituted succinic acid, and wherein the eight ratio of citric acid to $C_{10}$–$C_{16}$ alkyl or alkenyl substituted succinic acid is from 1.2:1 to 10:1 and wherein the composition has a building capacity of at least about 5.96.

2. A detergent composition according to claim 1 which comprises from 10% to 30% by weight of the total composition of a surfactant system, from 8% to 14% by weight of the total composition of citric acid and from 2% to 6% by weight of a $C_{10}$–$C_{16}$ alkyl or alkenyl substituted succinic acid, wherein the weight ratio of citric acid to $C_{10}$–$C_{16}$ alkyl or alkenyl substituted succinic acid is of from 1.5:1 to 6:1.

3. A composition according to claim 1 wherein the weight ratio of citric acid to $C_{10}$–$C_{16}$ alkyl or alkenyl substituted succinic acid is in the range of from 1.8:1 to 2.5:1.

4. A composition according to claim 1 wherein the substituted succinic acid is a $C_{12}$–$C_{14}$ alkenyl substituted succinic acid.

5. A composition according to claim 1 wherein the surfactant system consists of a mixture of $C_{12}$–$C_{15}$ alkyl sulphate and ethoxylated nonionic surfactant.

6. A composition according to claim 2 wherein the weight ratio of citric acid to $C_{10}$–$C_{16}$ alkyl or alkenyl substituted succinic acid is in the range of from 1.8:1 to 2.5:1.

7. A composition according to claim 2 wherein the substituted succinic acid is a $C_{12}$–$C_{14}$ alkenyl substituted succinic acid.

8. A composition according to claim 2 wherein the surfactant system consists of a mixture of $C_{12}$–$C_{15}$ alkyl sulphate and ethoxylated nonionic surfactant.

* * * * *